United States Patent [19]

Suchoff

[11] 4,144,790

[45] Mar. 20, 1979

[54] CHORAL GENERATOR

[75] Inventor: Michael A. Suchoff, Chestnut Hill, Mass.

[73] Assignee: Arp Instruments, Inc., Lexington, Mass.

[21] Appl. No.: 768,600

[22] Filed: Feb. 14, 1977

[51] Int. Cl.[2] ..... G10H 1/02

[52] U.S. Cl. ..... 84/1.24; 84/DIG. 4

[58] Field of Search .... 84/DIG. 1, DIG. 4, DIG. 19, 84/DIG. 27, 1.24, 1.27; 179/1 J, 1 M; 307/222, 223, 269; 328/69, 155; 331/55, 56, 172

[56] References Cited

U.S. PATENT DOCUMENTS 4,038,898 8/1977 Kniepkamp et al. ..... 84/1.24

*Primary Examiner*—Robert K. Schaefer
*Assistant Examiner*—Vit W. Miska
*Attorney, Agent, or Firm*—Cesari and McKenna

[57] ABSTRACT

A choral generator is formed from a plurality of delay channels, each including a modulated delay line which non-linearly varies the time delay imparted to a signal passing through it. The outputs of the delay channels are combined with the undelayed audio signal to form a composite output characterized by enhanced musical presence.

10 Claims, 4 Drawing Figures

CHORAL GENERATOR

BACKGROUND OF THE INVENTION

A. Field of the Invention

The invention relates to musical signal processing circuits and, more particularly, to musical signal processing circuits using one or more delay lines to process the output of an audio source.

B. Prior Art

Delay devices are used in audio signal processing to create effects not present in the original audio source. For example, an apparent "echo" may be added to an audio source by time-delaying the audio signal and adding it to itself prior to reproduction in a loudspeaker. The resultant signal has both the original and delayed components, and the listener thereby perceives an "echo" in the sound. The echo, of course, is wholly electronic, and is not the result of reflections from physical surfaces adjacent the listener, although it appears to result from such.

A simple implementation of a device of this type passes the audio signal through a delay line which provides a fixed time delay to each spectral (frequency) component in the signal. This improves the musical appeal of an audio signal which is otherwise free of echo effects, but the resultant signal still lacks the dynamism and realism characteristic of live acoustic signals.

An improvement over the simple device described above is shown in U.S. Pat. No. 3,833,752 issued Sept. 3, 1974 to Tigmen Van Der Kooig. The signal processor shown therein includes several time-delay channels, each delaying the signal applied to the respective channel by an amount dependent on the instantaneous ouput of a low-frequency oscillator. The oscillator is coupled to the respective channels through phase-shifting networks which provide differing amounts of phase shift in the respective channel driving signals; thus, the driving signals have the same frequency but different phases. This device, while an improvement over the constant delay type of device, still falls short of providing the presence and related dynamic effects characteristic of live sound emanating from a multi-instrument source.

BRIEF SUMMARY OF THE INVENTION

A. Objects of the Invention

Accordingly, it is an object of the invention to provide an improved musical signal processing device.

Further, it is an object of the invention to provide an improved choral generator.

Another object of the invention is to provide a choral generator which imparts an increased "presence" to a single voiced musical source.

B. Brief Description of the Invention

In accordance with the present invention, a choral generator has a plurality of signal processing channels, each providing to an audio signal applied thereto a time delay that is varied nonlinearly in accordance with the output of a control oscillator associated with that channel. The outputs of each of the channels are summed, together with the undelayed source signal, to form a composite signal which, when reproduced through a loudspeaker, has a presence more nearly characteristic of a multi-voiced, live acoustic source.

In particular, each delay channel includes a delay line having a plurality of stages, each of which stores a signal indicative of the audio signal applied as input to the delay line at an earlier time and transfers its stored signal to the following stage on command from a "clock." In the preferred embodiment described herein, the clock is a current controlled variable-frequency oscillator providing a two phase output signal for driving the delay line. Normally, the clock is set to operate at a fixed frequency $f_o$, corresponding to a fixed time delay $\tau_o$. In response to a control input, however, the clock frequency, and thus the time delay provided by the delay line, varies by a small amount about the quiescent value.

The control input is generated by a low frequency oscillator, typically having a frequency of the order of from fractions of a Hertz to a few tens of Hertz. The output of the low frequency oscillator is not applied directly to the clock control input, however, but is instead first passed through an exponential generator which provides an output proportional to the exponential of the frequency oscillator output. In the preferred embodiment described herein, the generator provides an output current whose amplitude is exponentially related to the amplitude of the low frequency oscillator output. Thus, the variation in the time delay provided by the delay line is not symmetric about its center value but, instead, is exponentially related to the center value. This provides a musically more pleasing sound when the output of each of the channels is summed with the undelayed audio signal and the composite signal reproduced in a loudspeaker. The resultant sound has noticeably more "presence."

In addition to the exponential converter, a low-pass filter may be included in the signal path between the low frequency oscillator output and the clock control input. This filter diminishes the time delay excursions when the low frequency oscillator operates at the higher end of its frequency range relative to the excursions obtained when the oscillator is operating at the lower end of its frequency range. This again enhances the tonal qualities of the sound reproduced by the present circuit.

DETAILED DESCRIPTION OF THE INVENTION

The foregoing and other and further objects and features of the invention will be more readily understood from the following detailed description of the invention when taken in conjunction with the accompanying drawings in which.

Figure 1:
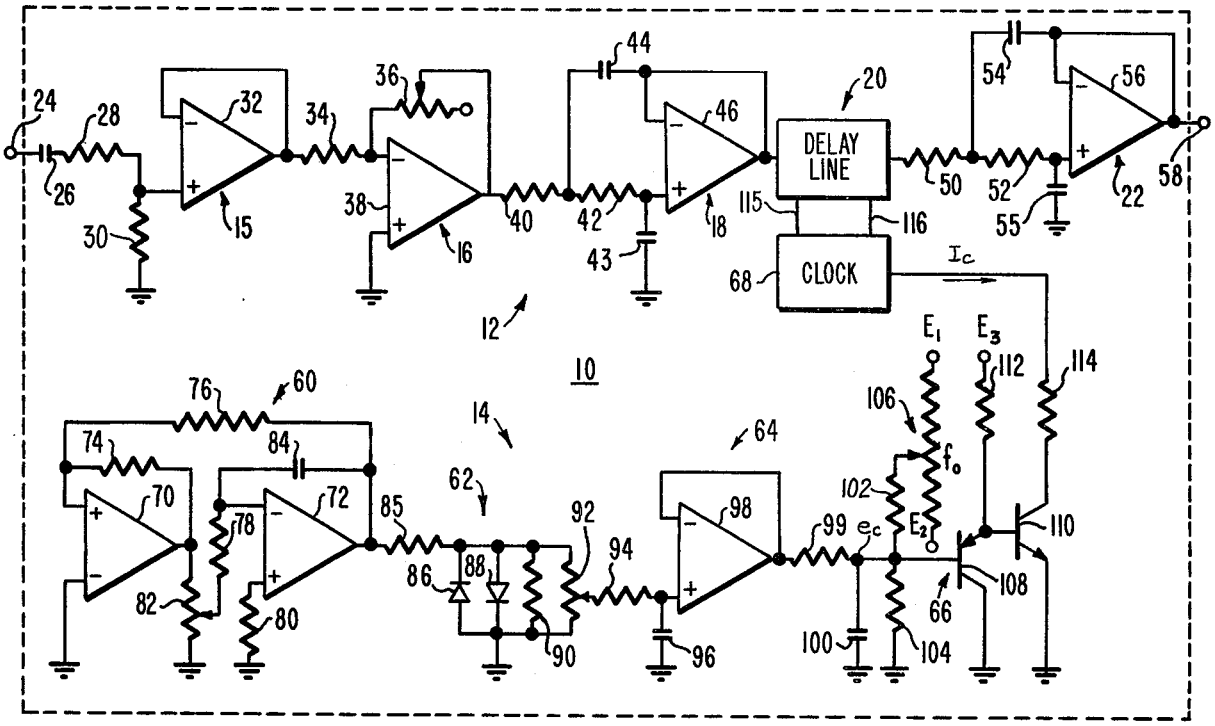
FIG. 1 is a block and line diagram of one channel of the choral generator of the present invention.

In FIG. 1, a typical delay channel 10 is formed from a signal channel 12 and a control channel 14. The signal channel includes a buffer stage 15 for receiving the audio input signal to be processed, a gain control stage 16, a low pass filter 18, a delay line 20, and a further low pass filter 22. The audio signal to be processed is applied to a delay channel input terminal 24 and thence coupled through a capacitor 26 to a buffer stage 15. The latter is formed from voltage dividing resistors 28 and 30 and a high input impedance, low output impedance, high gain (operational) amplifier 32 connected in a unity gain configuration. Buffer 15 isolates or "buffers" the signal processing stages subsequent to it from the signal sources which are connected to the terminal 24.

The gain control stage 16 following the buffer 14 is formed from a fixed resistor 34 and a variable resistor 36, the latter being connected to provide variable negative feedback around an operation amplifier 38. The stage 16 allows the voltage gain of the signal being processed in this channel to be changed by changing the magnitude of the resistor 36. Resistors 40, 42, capacitors 43, 44, and operational amplifier 46 form the low pass filter stage 18 of the audio signal channel 12. This stage filters out components in the audio signal which are above a selected frequency. This not only eliminates high frequency noise which may be present in the audio signal, but also insures that the signal will not have components of a frequency higher than the delay line 20 is capable of accomodating. Typically the filter 18 has a three-db cut off frequency of approximately 10 kHz.

After filtering, the audio signal is passed to the delay line 20 for further processing. The delay line 20 has a series of discrete storage stages, each of which receives a signal from a preceding stage, stores it for a time interval determined by the repetition rate of the clock which drives the delay line, and then transfers the signal to the next stage of the sequence. The first stage of the delay line effectively samples the output of the filter 18, while the last stage applies the signal to a further filter 22 which removes the high frequency components introduced by the delay line 20. Advantageously, the delay line is a type SAD 512 integrated circuit. Filter 22 is a low-pass filter, similar to the filter 18 and is formed from resistors 50, 52, capacitors 54, 55, and operational amplifier 56. The output of the filter 22 is applied to a delay channel output terminal 58.

Turning now to the control signal stage 14, it is formed from a low frequency oscillator 60, a wave shaping section 62, a low pass filter and buffer section 64, an exponential generator 66, and a current controlled oscillator or clock 68. The low frequency oscillator 60 comprises operational amplifiers 70 and 72, resistors 74, 76, 78 and 80, variable resistor 82, capacitor 84, and coupling resistor 85. It will be noted that the feedback around the amplifier 72 is negative feedback, while that around the entire loop back to the input of amplifier 70 is positive feedback. Initially, a small positive voltage at the positive input terminal of amplifier 70 causes the output to go positive by a large amount and part of this voltage will be fed back to the input of the amplifier, thereby driving it even more positive. Simultaneously, however, capacitor 84 charges through resistor 78 and part of resistor 82, making the output of amplifier 72 increasingly negative and this voltage also is fed back to the positive input of amplifier 70, thereby decreasing its net input and driving the output of amplifier 70 in the negative direction. This circuit thus provides a triangular wave at the output of the amplifier 72, the frequency of the output signal being determined by the capacitor 84, the resistor 78, and the setting of potentiometer 82. Typically, the oscillator operates at frequencies from 1/15 Hz to 20 Hz.

Wave shaping circuitry 62, comprising diodes 86 and 88, resistor 90, and potentiometer 92 smooth the upper and lower excursions of the triangular wave and provide a more nearly sinusoidal output. The output of circuit 62 is passed through a low pass filter formed from a resistor 94 connected to the wiper arm of potentiometer 92, together with a capacitor 96. An operational amplifier 98 is connected in a unity-gain configuration and acts as a buffer amplifier. It is followed by a resistor 99 and capacitor 100 which prevent feedback of the high frequency clock pulses from the clock 68. The filter 64 furnishes a decreasing drive signal to the exponential generator 66 as the oscillator frequency increases, and thereby provides effective frequency "compression" for the oscillator frequency excursion which enhances the musical realism of the resultant sound passed through the delay channel.

The exponential generator 66, which receives the output of filter 64, is formed from fixed resistors 102, 104, potentiometer 106, transistors 108 and 110 and resistors 112 and 114. The base of the transistor 108 is supplied with a biasing potential from voltage sources $E_1$ and $E_2$ through potentiometer 106 and resistors 102 and 104. The emitter of transistor 108 is supplied with biasing potential from a voltage source $E_3$ via resistor 112. The collector current, $I_c$, of the transistor 110 is an exponential function of its base-to-emitter voltage, $V_{eb}$, according to the well-known Boltzmann relationship, i.e.:

$$I_c = I_1 [\exp(-qVeb/kT) - 1],$$

where $I_1$ is the emitter junction saturation current and kT/q, the thermal voltage, is approximately 26mv at room temperature; k is Boltzmann's constant, q is the electronic charge and T is the absolute temperature. The emitter-to-base voltage $V_{eb}$ of transistor 110 is equal to the collector-to-emitter voltage $V_{ce}$ of transistor 108 which, in turn, is a function of the base current of transistor 108, and thus the driving voltage applied to it. Thus, for a given bias voltage, the current in the collector of transistor 110 is an exponential function of the filtered low frequency oscillator driving voltage $e_c$ appearing at the junction of the resistor 99 and the capacitor 100. This current is applied to the control input of clock 68 which comprises a current controlled oscillator whose frequency is proportional to the driving current applied to it. The oscillator section of an RCA 4046 integrated circuit has been found useful for this purpose. The center frequency, $f_o$, of the clock 68 is set by means of the potentiometer 106. The frequency is then made to perform small excursions about the center frequency by varying the control current voltage applied to it through the exponential generator 66.

The clock 68 applies oppositely phased outputs via leads 114, 116 to delay line 20. These outputs cause the delay line to successively shift the signal stored in its various stages from the input toward the output. If the input to clock 68 were constant at the quiescent level, that is, the level corresponding to the center frequency $f_o$, the clock 68 would shift the delay line at a constant rate and thus a constant delay $\tau_o = n/2f_o$, where n = the number of stage in the delay line, would be imparted to the audio signal passing through the delay line. However, the oscillator 60 varies the control current in the collector circuit of transistor 110, and thus varies the oscillator driving frequency, nonlinearly. In other words, the oscillator 60 non-linearly modulates the frequency of clock 68 and thereby non-linearly modulates the delay imparted to the signal by the delay line 20.

Figure 2:
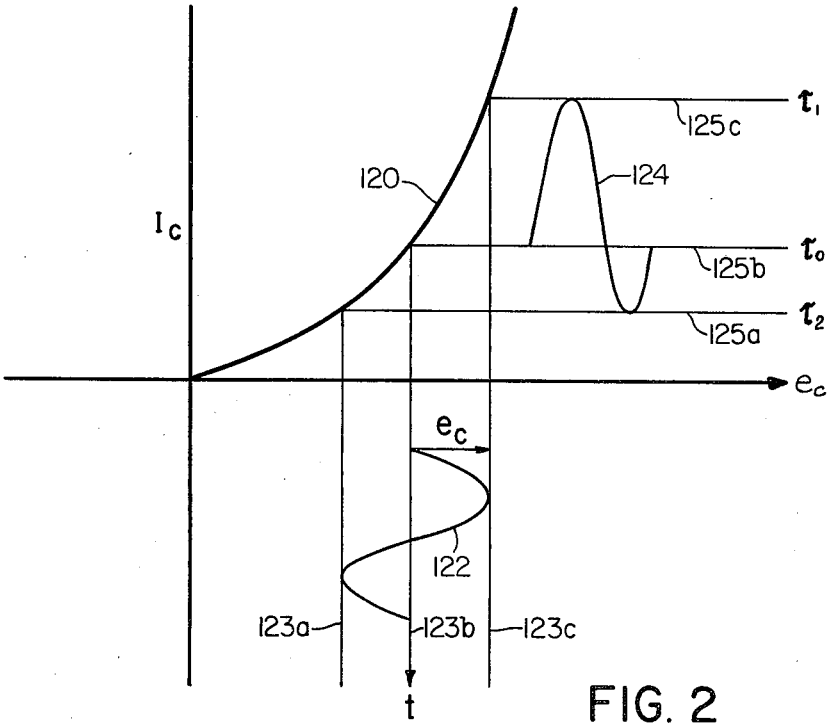
FIG. 2 is a sketch illustrating the relationship between the oscillator output and the control current applied to the clock, and further showing the time delay variation obtained from the control voltage.

FIG. 2 illustrates the operation of the control channel 14. As there shown, the relation between the control voltage $e_c$ appearing at the input to the exponential generator 66 and the collector current $I_c$ of the transistor 110 is nonlinear and, specifically, is an exponential function 120. Thus, a typical control voltage waveform 122 applied as the input signal to the exponential generator 66 results in an assymetric control current waveform 124. A positive excursion of this control current waveform causes the oscillator 68 to smoothly shift from its center frequency $f_o$ corresponding to a time delay $\tau_o = n/2f_o$ to a frequency $f_1$ corresponding to an increased time delay, $\tau_o = n/2f_1$. Correspondingly, a negative excursion of the control current waveform 124 causes the output of oscillator 68 to shift from its center frequency $f_o$ to a lesser frequency $f_2$ corresponding to a reduced time delay $\tau_2 = n/2f_2$. Lines 123*a*, 123*b*, 123*c* and 125*a*, 125*b*, and 125*c* are merely graphical construction lines drawn parallel to the ordinate and abscissa, respectively, to illustrate graphically how the exponential relationship of function 120 transforms waveform 123 into waveform 124.

Thus, the time delay provided by the delay line 20 is modulated by the control current waveform 124. Further, the modulation is non-linear and, specifically, exponential, and varies at the rate of the low frequency oscillator 60. When the output of channel 10 is added to the outputs of similar channels, together with the undelayed waveform, the resultant signal, when reproduced by a loudspeaker, recreates the effect of a live acoustic signal emanating from a multivoiced source and does so with greater presence than heretofore provided.

Figure 3:
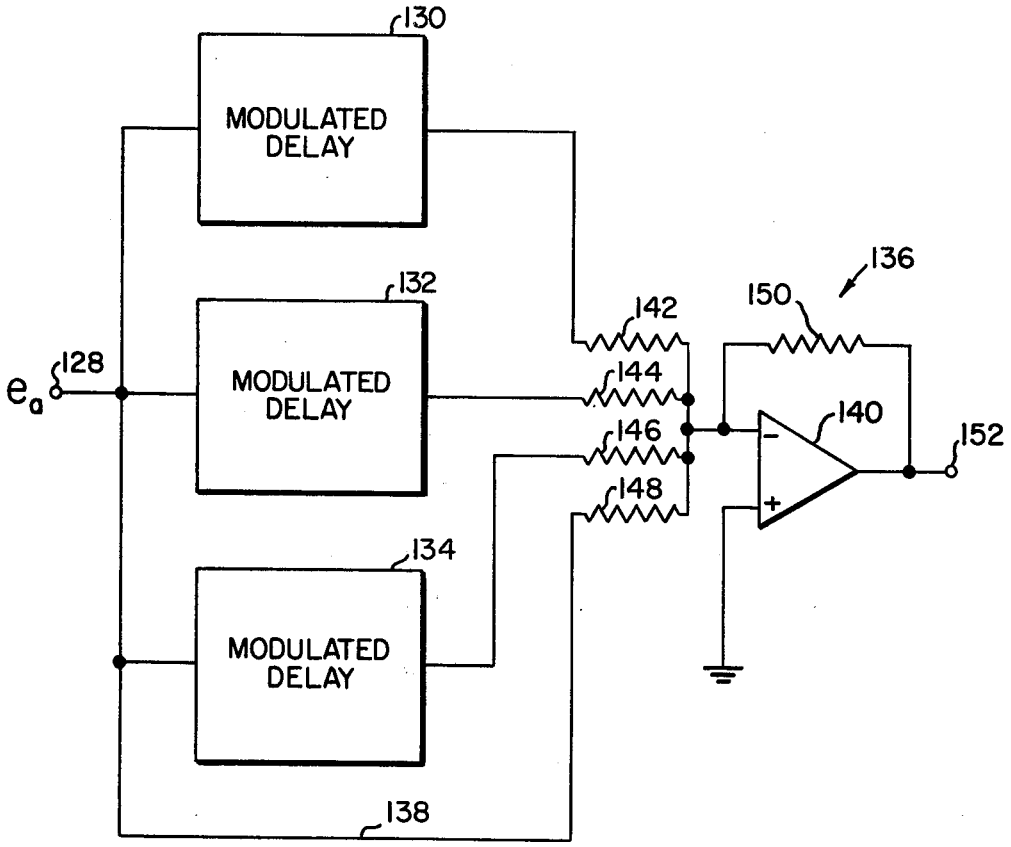
FIG. 3 is a block and line diagram showing a choral generator formed from a plurality of delay channels in accordance with the present invention.

FIG. 3 shows a choral generator formed from a plurality of delay channels in accordance with the present invention. As there shown, an audio input signal $e_a$ is applied to an input terminal 128 whence it is supplied to modulated delay devices 130, 132, and 134 of the type shown in FIG. 1. The output of these devices is then applied to a summing circuit 136, together with the delayed audio signal which is applied to the summer via a lead 138. The summer is conventional, and consists of an operational amplifier 140, input resistors 142, 144, 146, and 148 and feedback resistor 150. The output of the summer is taken from the terminal 152 and supplied to a reproduction device, i.e. a loudspeaker. Typically, an equal mixture of signals from the various channels will be found to be musically pleasing, but the mixture can, of course, be varied by varying the value of the resistors 142–148.

Figure 4:
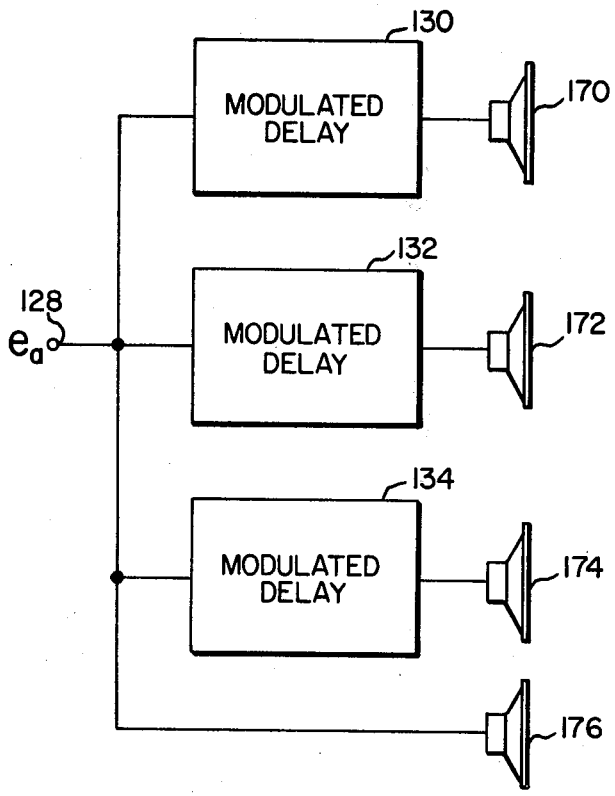
FIG. 4 is a block and line diagram showing an alternative form of choral generator in accordance with the present invention.

Alternatively, the outputs of the various channels can be applied directly to the reproduction devices (loudspeakers) as shown in FIG. 4 in which the outputs of delay channels 130, 132, and 134 are applied to speakers 170, 172 and 174, respectively, while the input is applied directly to speaker 176. The result is similar to "true" stereophonic sound, despite the fact that the sound in each speaker originates in a common source.

SUMMARY

From the foregoing it will be seen that I have provided an improved choral generator formed from a plurality of delay lines, each providing nonlinear, and specifically exponential, modulation of the delay channels in each line. Each channel provides a modulated delay that is independent (i.e. unrelated in amplitude, frequency and phase) of the delay modulation in any other channel, so that the outputs are continually shifting in phase with respect to each other to thereby more realistically simulate an ensemble of several instruments playing together with random phase differences. The circuit is relatively simple and inexpensive to construct and is thus efficient.

It will be understood that various changes may be made in the foregoing without departing from either the spirit or the scope of the invention. As one example, the delay line 20 of each channel, which has been shown and described as an analog delay line, may instead be implemented as a digital shift register preceeded by an analog to digital converter and followed by a digital to analog converter, the shift register being driven by the clock in the manner described above for the analog delay line. Various other changes may similarly be made and it is intended that the foregoing be taken as illustrative only and not in a limiting sense, the scope of the invention being described with particularity in the claims.

I claim:

1. In a choral generator having a plurality of delay lines forming a corresponding plurality of delay channels for delaying a signal applied in common thereto, the improvement comprising a separate independed delay modulator for each said delay line, each modulator comprising A. a clock connected to drive a corresponding one of said delay lines at a rate determined by a control input applied thereto, B. an oscillator providing a time-varying output signal, and C. driving means connected to receive said oscillator output signal and providing to the control input of said clock a driving signal that is a non-linear function of said output signal.

2. A choral generator according to claim 1 in which said driving means comprises means forming an exponential signal generator providing an output exponentially related to the oscillator output.

3. A choral generator according to claim 1 which includes means for independently varying the frequency of the oscillator output signal to thereby vary the rate at which the time-delay provided by each said delay line is provided.

4. A choral generator according to claim 3 which includes means for varying the amplitude of the oscillator output signals applied to the driving means to thereby vary the range of time-delays provided by said delay line in response to said driving signal.

5. A choral generator according to claim 2 which includes frequency-responsive means interposed between said oscillator and said exponential generator for modifying the output of said oscillator as a function of frequency.

6. A choral generator according to claim 5 in which said frequency responsive means includes a capacitor shunting an increasing portion of the exponential generator input to ground as the frequency of said input increases.

7. Sound reproduction apparatus including a plurality of delay lines forming a corresponding plurality of delay channels for independently delaying a common audio signal applied thereto, each delay channel including A. an oscillator providing a time-varying output for controlling the time delay of said audio signals, said oscillator including (1) means for varying the frequency of said output to thereby vary the rate at which said time delay is varied, and (2) means for varying the amplitude of said output to thereby vary the extent to which time delay is varied, B. an exponential signal generator connected to receive the output of said oscillator and providing a driving signal that is an exponential function of said oscillator output signal, and C. an analog delay line having a control input connected to receive driving signals from said exponential generator and varying the time-delay of audio input signals applied to said delay line by an amount proportional to said driving signal.

8. Apparatus according to claim 7 in which said oscillator comprises a low frequency oscillator having an output frequency not greater than approximately 20 Hz.

9. Apparatus according to claim 8 in which said oscillator includes means to set the output frequency over a range extending from a fraction of a hertz to approximately 20 Hz.

10. Apparatus according to claim 7 which includes means providing an adjustable bias to said exponential generator to thereby adjust the quiescent frequency driving said delay line.

* * * * *

UNITED STATES PATENT AND TRADEMARK OFFICE

CERTIFICATE OF CORRECTION

PATENT NO. : 4,144,790

DATED : March 20, 1979

INVENTOR(S) : Michael A. Suchoff

It is certified that error appears in the above–identified patent and that said Letters Patent are hereby corrected as shown below:

Column 4, line 53, change "114" to -- 115 --

Column 5, line 13, change "$\tau_0$" to -- $\tau_1$ --

Signed and Sealed this

*Seventeenth* Day of *June 1980*

[SEAL]

*Attest:*

SIDNEY A. DIAMOND

*Attesting Officer*

*Commissioner of Patents and Trademarks*